US011851835B1

(12) United States Patent
Gordon et al.

(10) Patent No.: US 11,851,835 B1
(45) Date of Patent: Dec. 26, 2023

(54) DEVICE FOR PICKING UP AND CARRYING PET EXCREMENT

(71) Applicants: William Michael Gordon, Ellensburg, WA (US); Ryan S. Rose, Puyallup, WA (US)

(72) Inventors: William Michael Gordon, Ellensburg, WA (US); Ryan S. Rose, Puyallup, WA (US)

( * ) Notice: Subject to any disclaimer, the term of this patent is extended or adjusted under 35 U.S.C. 154(b) by 0 days.

(21) Appl. No.: 18/235,288

(22) Filed: Aug. 17, 2023

Related U.S. Application Data

(60) Provisional application No. 63/398,664, filed on Aug. 17, 2022.

(51) Int. Cl.
*E01H 1/12* (2006.01)

(52) U.S. Cl.
CPC ..... *E01H 1/1206* (2013.01); *E01H 2001/128* (2013.01)

(58) Field of Classification Search
CPC ..... E01H 1/1206; E01H 2001/128
See application file for complete search history.

(56) References Cited

U.S. PATENT DOCUMENTS 4,225,174 A * 9/1980 Hennessy ..... E01H 1/1206 294/1.4
5,601,321 A * 2/1997 Simon ..... E01H 1/1206 294/1.4
6,986,325 B1 1/2006 Hsu
7,448,659 B1 11/2008 Auseklis
7,523,972 B1 4/2009 Wawrzynowski
8,196,980 B1 6/2012 Banks
8,292,339 B1 10/2012 Auseklis
8,899,643 B2 12/2014 Sigmund
9,624,631 B2 4/2017 Baker
2006/0214442 A1* 9/2006 Jones ..... E01H 1/1206 294/1.4
2008/0265592 A1 10/2008 Askinasi
(Continued)

FOREIGN PATENT DOCUMENTS

WO 2014020452 A1 2/2014

OTHER PUBLICATIONS

"DogBuddy Portable Dog Poop Scooper, Sanitary Waste Pick Up, Heavy Duty Cleaner with Dispenser, Leash Clip and Pooper Scooper Bags Included," amazon.com. https://www.amazon.com/DogBuddy-Portable-Sanitary-Dispenser-Included/dp/B074115FTG/ref=asc_df_B074115FTG/?tag=hyprod-20&linkCode=df0&hvadid=241894907660&hvpos=&hvnetw=g&hvrand=15777187776090812946&hvpone=&hvptwo=&hvqmt=&hvdev=c&hvdvcmdl=&hvlocint=&hvlocphy=9002074&hvtargid=pla-404678170262&th=1 [Date accessed: Feb. 5, 2022].

(Continued)

*Primary Examiner* — Stephen A Vu
(74) *Attorney, Agent, or Firm* — Bold IP, PLLC; Binita Singh

(57) ABSTRACT

A device adapted to pick up a solid waste includes a pair of opposing shells that are pivotally linked to each other to form an enclosure. Each of the opposing shells includes a compartment having hollow tubular body having an open end and a closed end, wherein the closed ends are configured to connect to each other and allow the opposing shells to pivot at the connection. The device is adapted to pivot open by a tension force allowing the device to be used for scooping up solid waste and manually closing the enclosure and locking the opposing shells in a closed position to hold the waste within the enclosure.

18 Claims, 5 Drawing Sheets

(56) References Cited

U.S. PATENT DOCUMENTS

| | | | | |
|---|---|---|---|---|
| 2011/0193359 | A1* | 8/2011 | Howard | E01H 1/1206 294/1.3 |
| 2012/0098281 | A1* | 4/2012 | Sigmund | A01K 27/008 294/1.3 |
| 2017/0191235 | A1 | 7/2017 | Bean | |

OTHER PUBLICATIONS

"Arm & Hammer Pooper Scooper Claw Scoop Dog Poop Scooper for Yard Pet Waste Management System," amazon.com. https://www.amazon.com/Petmate-Scooper-Management-Included-Premium/dp/B00935OD9C/ref=sr_1_4?crid=UTI3R5ZB1RJM&keywords=arm%2Band%2Bhammer%2Bpooper%2Bscooper&qid=1692039473&s=pet-supplies&sprefix=arm%2Band%2Bhammer%2Bpooper%2Bscooper%2Cpets%2C93&sr=1-4&th=1 [Date accessed: Feb. 5, 2022].

HandiScoop, handiscoop.com. https://handiscoop.com/ [Date accessed: Feb. 5, 2022].

* cited by examiner

DEVICE FOR PICKING UP AND CARRYING PET EXCREMENT

CROSS REFERENCE TO RELATED APPLICATIONS

This application is a non-provisional application claiming priority to U.S. Provisional Patent Application No. 63/398,664 filed on Aug. 17, 2022, which is incorporated in its entirety.

FIELD OF THE DISCLOSURE

The present invention relates to a device to pick up and carry pet feces for disposal.

BACKGROUND

Owning a pet brings many benefits, among which some include better cardiovascular health and companionship. It is suggested that owning a pet, such as a dog, can help the pet owner live longer. Some of that may have do with the joy that owning a pet brings, but also suggestive of the fact that most dogs need to be walked, and so people who own dogs tend to walk more, benefiting their cardiovascular health.

However, with pet ownership, especially dog ownership, picking up feces after the dog is not exactly the most enjoyable chore. It can be tempting to skip this task but leaving dog feces on the ground is bad for the environment, unsightly, and lacking common courtesy for an unsuspecting person who can step on the dog feces. Picking up after a dog is not only a responsible part of pet ownership but is also a considerate thing to do. Because picking up pet excrement is the right thing, it would be desirable to easily pick up dog excrement or other pet excrement. However, the most common method of picking up after a pet is using a disposable bag placed over the hand and picking up the excrement. The task of doing that may feel unpleasant.

Accordingly, there exists a need for improved means of picking up and carrying pet excrement for disposal that may address these and other existing issues.

SUMMARY

One or more embodiments are provided below for a pet excrement grab and carry device. The pet excrement grab and carry device may include two opposing jaw assemblies, a first jaw assembly and a second jaw assembly, that interact with each to grab and hold the pet excrement. The first and second jaw assemblies are adjacent to each other and are pivotally connected to each other. A spring element may bias the opposing jaws in an open position when no external force is applied. The first and second jaw assemblies include elements that connect the two together and also include elements that work with the spring element to bias the two opposing jaw assemblies in the open position.

Further, the first jaw assembly and the second jaw assembly include a slide lock button and slide lock channel that provide a mechanism to lock the opposing jaw assemblies in a closed position when an external pressure is applied to close the opposing jaws.

The second jaw assembly may further include a compartment to store a roll of disposable bags. Preferably, the compartment in the second jaw assembly may include a slot that provides a passage from an interior of the compartment to a space between the opposing jaws, so that a bag may be unrolled from the roll of disposable bags. An open end of the bag may be pulled into the interior of the compartment and the open ends may be placed around the exterior of the opposing jaws when in the open position with a closed end of the bag within the interior of the opposing jaws. A user may then capture the pet waste within the bag by putting external pressure on the opposing jaws and closing the opposing jaws around the pet waste. The bag may then be tied closed and the bag with the pet waste is securely held in the compartment within the opposing jaws before disposing of the waste at an appropriate site.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
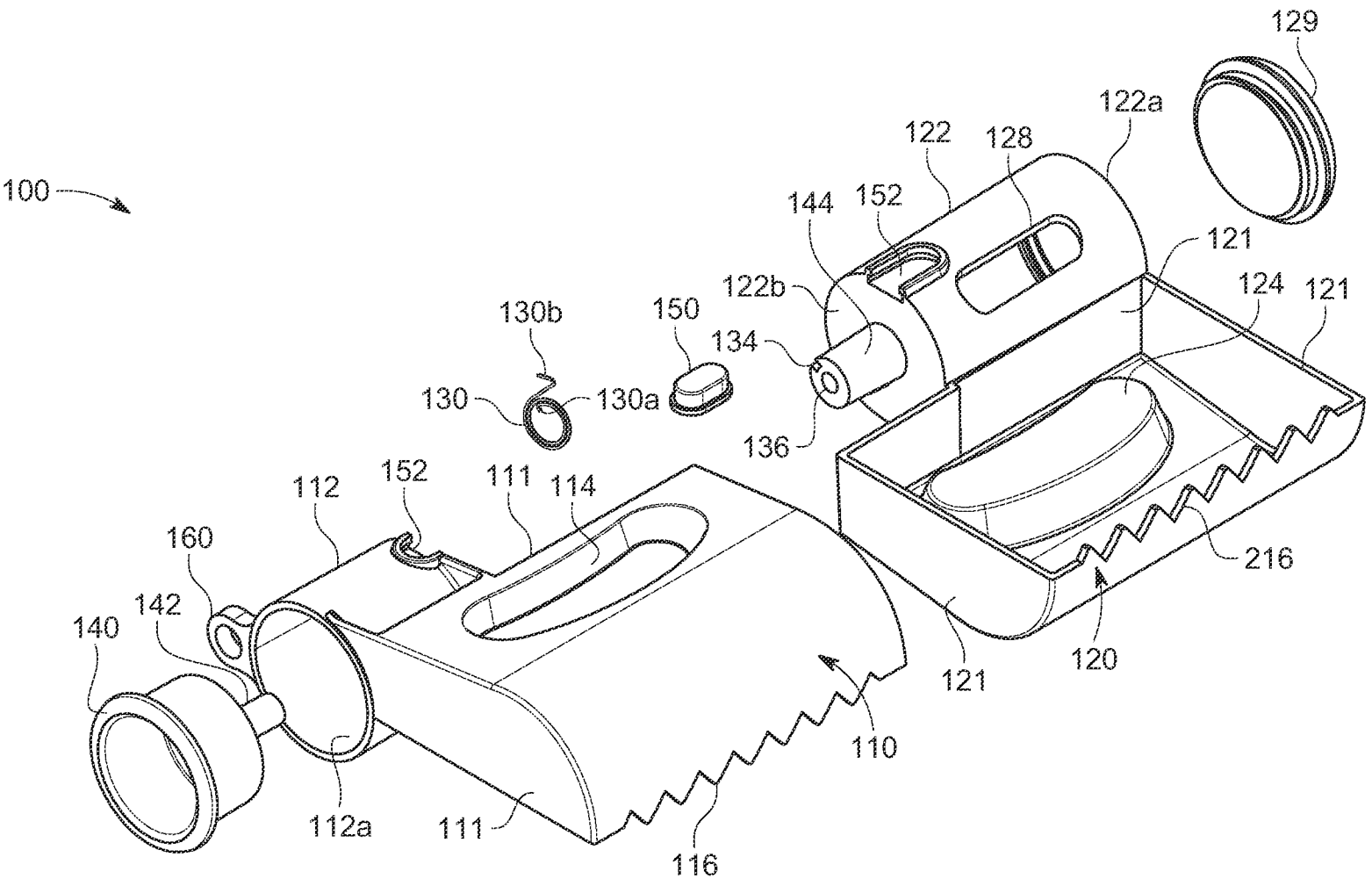
FIG. 1 is a pictorial illustration of an expanded view of the grab and carry device in accordance with an illustrative embodiment.

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

The present disclosure is generally drawn to various embodiments for a pet excrement grab and carry device. In accordance with one or more embodiments, the pet excrement grab and carry device provides a device related to the collection of at least one pet waste item using at least one pet excrement grab and carry device. The disclosed device may be a handheld device that allows a user to load a disposable bag that is stored within a compartment in the device. The disposable bag is placed around an outside of the device and the pet waste is grabbed and encapsulated by the bag. The device with the disposable bag makes picking up the pet waste a more pleasant experience for a human as the hand holding the device does not sense the feel of the pet waste.

Turning to the figures, FIGS. 1 to 7 illustrate an example embodiment of a pet excrement grab and carry device 100. FIG. 1 is an illustration of an exploded view of a pet excrement grab and carry device 100 which is an example of a device for picking up pet waste and carrying for disposal. It is noted that the pet excrement grab and carry device 100 may be interchangeably used with the words "grab and carry device" or "device" for purposes of brevity. In one or more non-limiting embodiments, the device 100 is suited or adapted for use as a handheld device which may be lined with a disposable bag assisting a user to pick up pet waste.

In one or more non-limiting embodiments, the device 100 may include two opposing shells, a first shell 110 and a second shell 120, that are pivotally connected to each other. The device 100 also comprises a spring compartment 112 and a bag storage compartment 122 configured on the first shell 110 and the second shell 120, respectively. Also seen in FIG. 1, the device 100 includes a spring 130 and a locking element 150. Further, the device 100 also includes indentations 114, 124 on the first shell 110 and the second shell 120, respectively.

Figure 4:
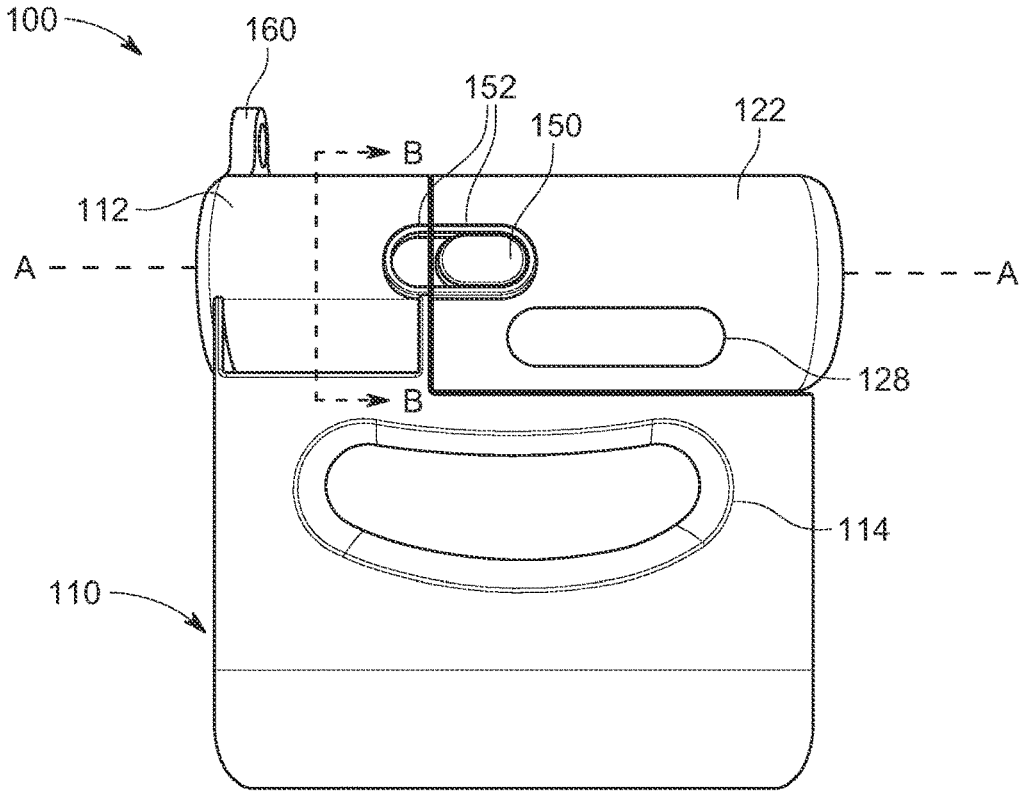
FIG. 4 a pictorial illustration of a top view of a grab and carry device in accordance with an illustrative embodiment.
Figure 5:
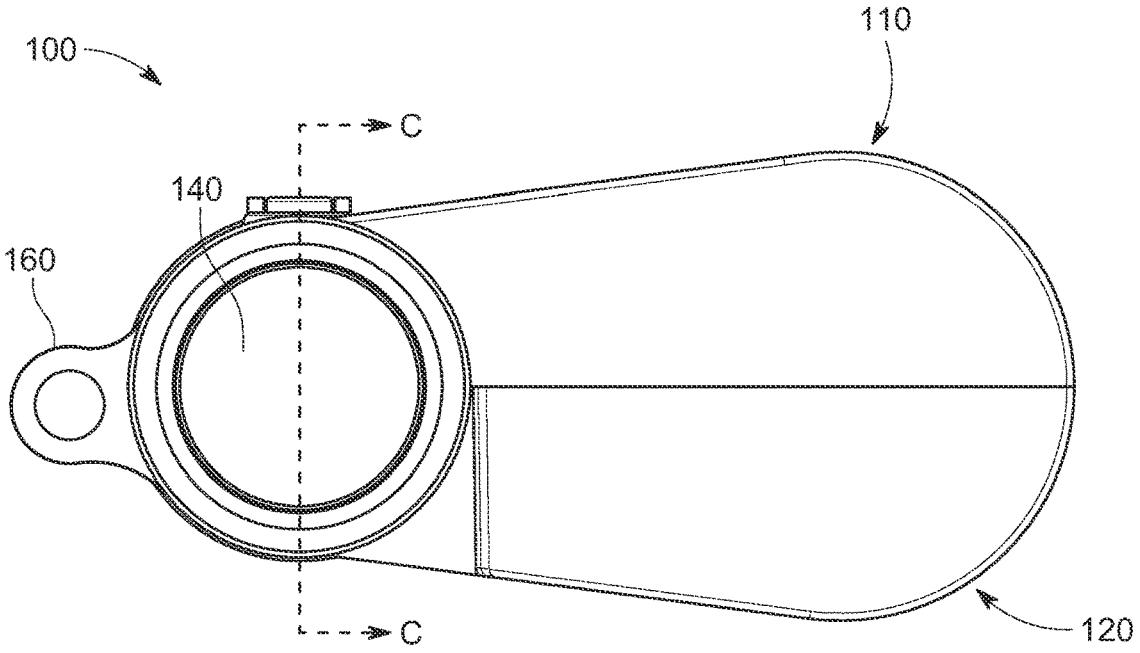
FIG. 5 is a pictorial illustration of a side view of a grab and carry device in accordance with an illustrative embodiment.
Figure 8:
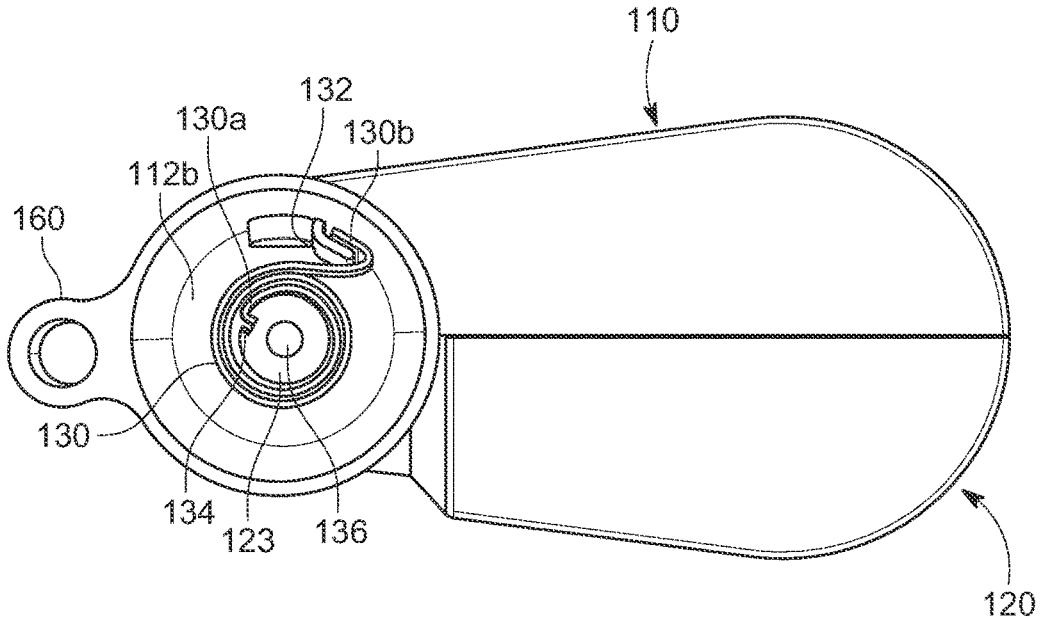
FIG. 8 is side view of a grab and carry device illustrating a view of the interior of the spring compartment when the device is in a closed position in accordance with an illustrative embodiment.

The first shell 110 and the second shell 120 are pivotally connected to each other whereby forming an enclosure to grab and hold pet waste within a housing formed by the enclosure. FIG. 5 illustrates a side view of the device 100 in a closed configuration forming the enclosure. The configuration of the first shell 110 and the second shell 120 may be such that the when the first and second shells 110, 120 are articulated toward each other, they form an enclosed container. Ideally, the first and second shells 110, 120 have a concave interior wherein one or more edges 111, 121 for the first shell 110 and the second shell 120, respectively, are together adapted to form the enclosed container. The enclosure is formed in a closed position in which the opposing shells 110, 120 lie adjacent to each other as shown in FIGS. 4, 5, and 8. In the closed position, the opposing shells 110, 120 have an equal length and a width such that the opposing shells 110, 120 join or touch along the one or more edges 111, 121 of each to form the enclosure. Alternatively, one or more edges 111 of the first shell 110 may overlap over one or more edges 121 of the second shell 120 or vice versa. As seen in the non-limiting embodiment, the opposing shells 110, 120 have an equal length and width wherein the one or more edges 111 of the first shell 110 are in line with the one or more edges 121 of the second shell 120. It can be readily appreciated by those of ordinary skill in the art that other shell shapes and configurations are possible, such as and not limited to, square, triangle, semicircle, polygon, and other complex and artistic shapes.

The first shell 110 may also be configured with the spring compartment 112. The spring compartment 112 may have a hollow tubular structure having an open end 112*a* and a closed end 112*b* (seen in FIG. 6). The spring compartment 112 is configured along one of the one or more edges 111, in particular, along an edge that is opposite an edge having a plurality of teeth 116. Further, the second shell 120 may also be configured with a compartment, referred to as the bag compartment 122. The bag compartment 122 may also have a hollow tubular structure having an open end 122*a* and a closed end 122*b*. The bag compartment 122 is also configured along one of the one or more edges 121 that is opposite an edge having a plurality of teeth 126 on the second shell 120.

Figure 2:
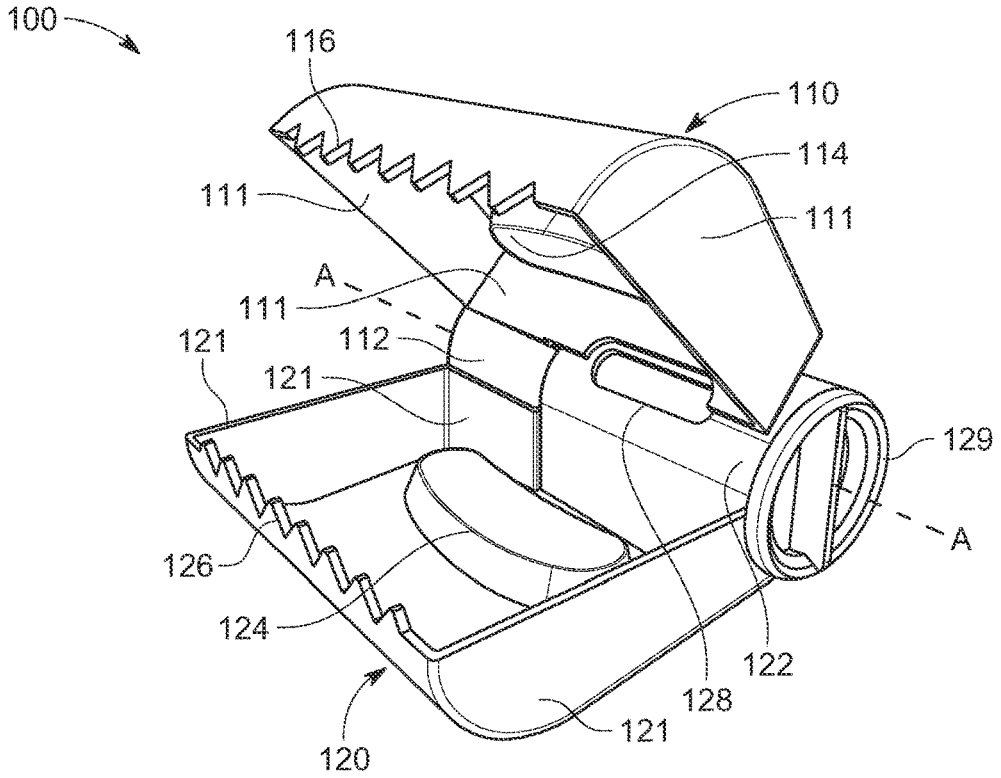
FIG. 2 is a pictorial illustration of a front perspective view of the grab and carry device in an open position in accordance with an illustrative embodiment.
Figure 3:
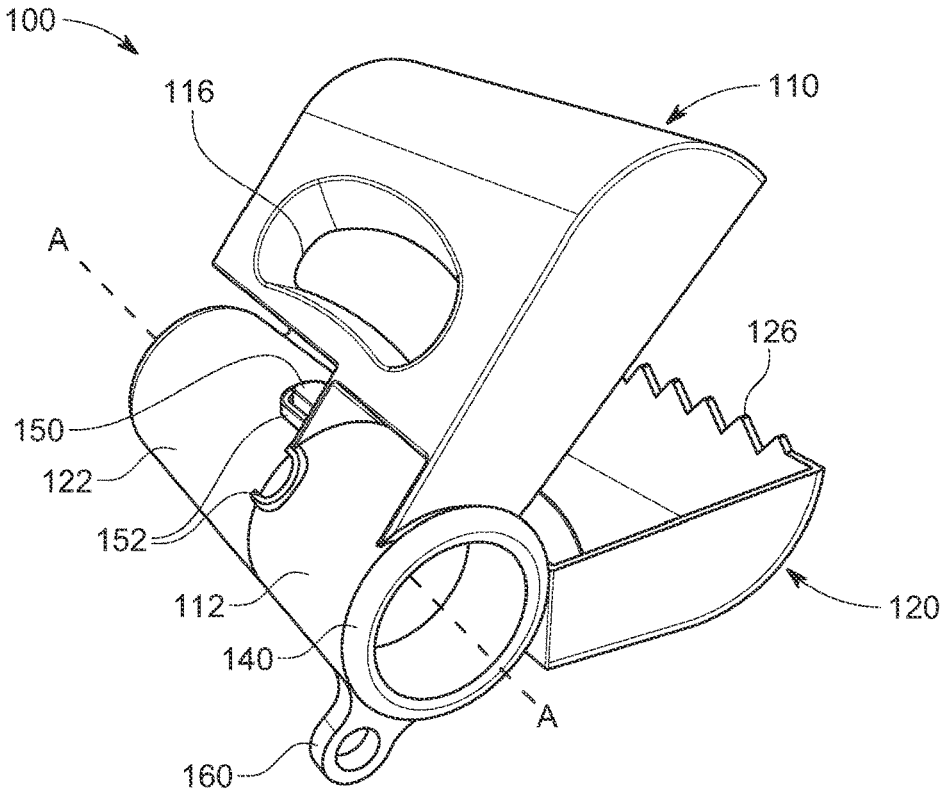
FIG. 3 is a pictorial illustration of a rear perspective view of the grab and carry device in an open position in accordance with an illustrative embodiment.
Figure 6:
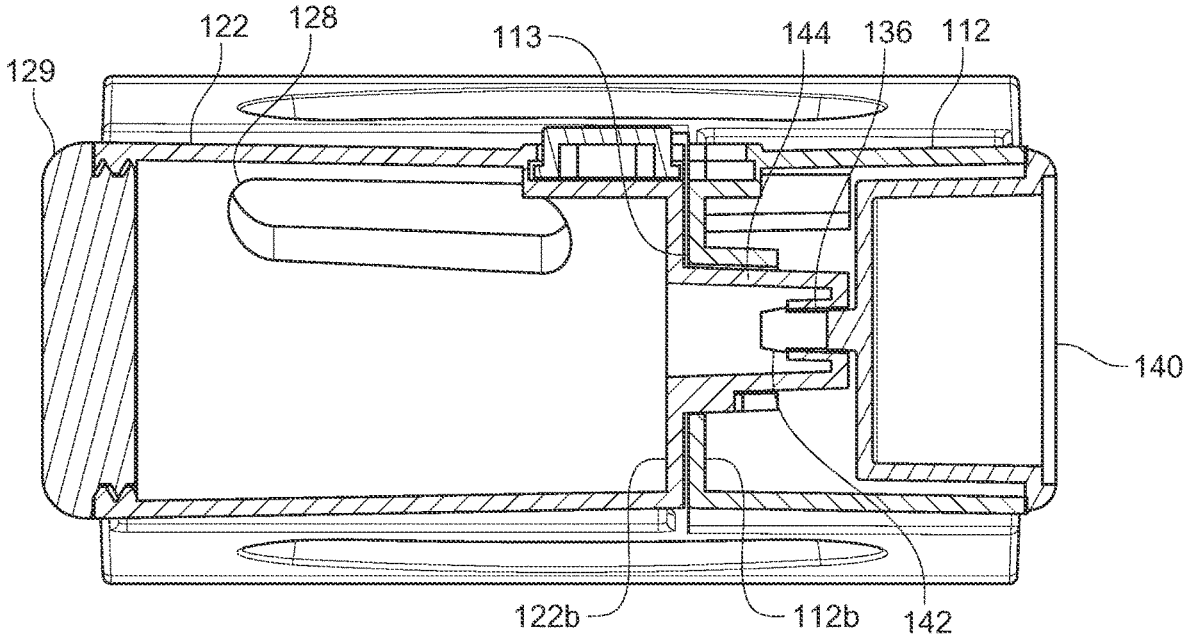
FIG. 6 is cross-section view of a grab and carry device taken along line C-C of the device in FIG. 5 in accordance with an illustrative embodiment.
Figure 7:
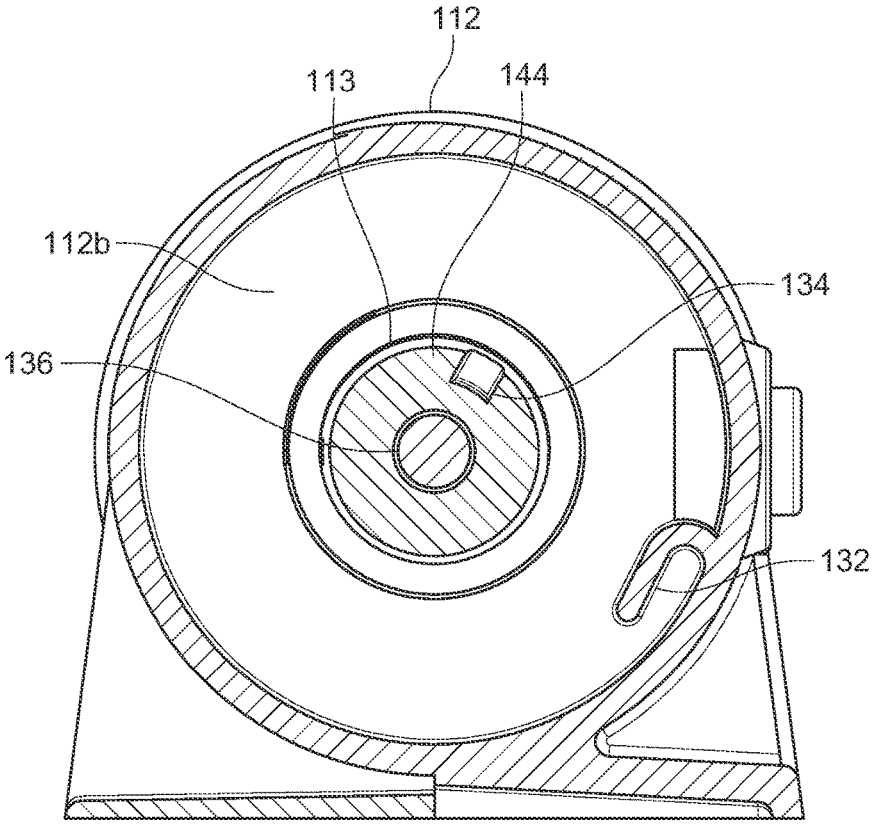
FIG. 7 is a cross-sectional view of the grab and carry device taken along line B-B of the device in FIG. 4 in accordance with an illustrative embodiment.

The bag compartment 122 and the spring compartment 112 are configured to connect with each other forming a pivoting connection along a common axis A-A of rotation (FIGS. 2 to 4). The spring compartment 112 has a length that extends to part of a length of the edge 111 the spring compartment 112 is configured to. Similarly, the bag compartment 122 also has a length that extends to part of a length of the edge 121 the bag compartment 122 is configured to. The closed end 112*b*, 122*b* of the spring compartment 112 and the bag compartment 122 abut against each other when the first shell 110 and the second shell are coupled together. FIG. 6 illustrates the closed ends 112*b*, 122*b* abutting against each other to couple the device 100 together. The first shell 110 and the second shell 120 pivot at the common axis A-A through their respective first spring and bag compartments 112, 122 thereby achieving the open or the closed position.

As mentioned above, the spring compartment 112 and the bag compartment 122 have a relatively tubular structure. As best seen in FIGS. 3 and 6, the spring compartment 112 and the bag compartment 122 have an equal diameter such that the closed ends 112*b*, 122*b* abut against each other to pivot smoothly. It is also to be understood that the diameters of the spring compartment 112 and the bag compartment 122 can differ. For example, the bag compartment 122 may have a diameter that is slightly smaller than a diameter of the spring compartment, such that the difference in the diameters allows the bag compartment 122 to snugly slide and fit within the spring compartment 112, where an outer surface of the bag compartment 122 abuts against an inner surface of the spring compartment 112. The bag compartment 122 fits snugly within the spring compartment 112 with enough give whereby the bag compartment 122 and the spring compartment 112 can pivot between the open and close positions along the common axis A-A.

The one or more embodiments illustrated in the figures provide an example of the device 100 with the spring and bag compartments 112, 122 having equal diameters. As mentioned above, the configurations of the spring and bag compartments 112, 122 and their interaction with each other results in the pivoting of the first shell 110 and the second shell 120. The closed end 112*b* of the spring compartment 112 and the closed end 122*b* of the bag compartment 122 include an aperture 113 and a projection 144, respectively. The aperture 113 is sized to permit the projection 144 on the bag compartment 122 to fit through and extend into the spring compartment 112. This arrangement aligns and connects the first shell 110 and the second shell 120 together. Further, the open end 112*a* of the spring compartment 112 can be closed by a cap, referred to as a spring compartment cap 140. The spring compartment cap 140 also includes a projection 142 that fits into a gap 136 in the bag compartment projection 144 ensuring that the two opposing shells 110, 120 are held in place when arranged together but are still capable of pivoting along the A-A axis.

Figure 9:
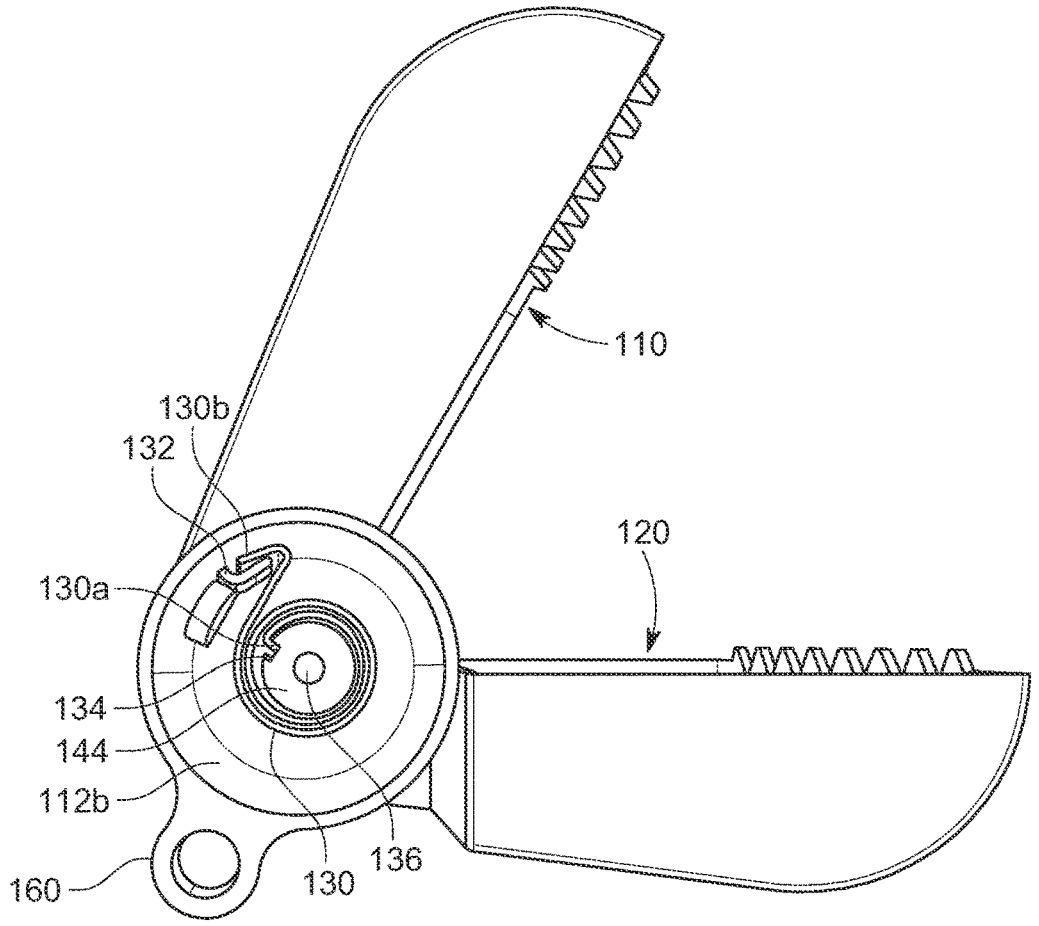
FIG. 9 is side view of a grab and carry device illustrating a view of the interior of the spring compartment when the device is in an open position in accordance with an illustrative embodiment.

The spring compartment 112 and the bag compartment 122 further include one or more elements that assist in the pivoting motion along the A-A axis allowing the opposing shells 110, 120 to open and close. Preferably, the device 100 is biased to the normally open position, as seen in FIG. 9. It is to be understood that the biasing can be adapted to the normally closed position, however, considering the purpose of the device 100, the appropriate arrangement is to have the device 100 biased to normally open. The biasing is achieved by the application of a tension force, an example of which is illustrated in FIGS. 1, 8, and 9 as the spring element 130. The spring compartment 112 houses the spring element 130, such as a clock spring 130. The clock spring 130 interfaces with both the spring compartment 112 and the bag compartment 122 to bias the first shell 110 and the second shell 120 in the naturally open position (FIG. 9).

In particular, the clock spring 130 interfaces with a slot 134 configured along a length of the bag compartment projection 144. Recall, the bag compartment projection 144 is inserted into the spring compartment 112 through the aperture 113 in the closed wall 112*b*. An inner surface of the spring compartment 112 includes an L-shaped hook 132. As best seen in FIGS. 8 and 9, the clock spring 130 is spiral shaped and has a number of coils wherein a load is introduced into the clock spring 130 via legs, an inner leg 130*a* and an outer leg 130*b*. The inner leg 130*a* is typically bent at a 90-degree angle, whereas the outer leg 130*b* may have an inner radius less than 90 degrees. Other variations to the outer leg 130*b* are possible based on the location of the L-Shaped hook. The clock spring is slipped onto the bag compartment projection 144 with the inner leg 130*a* inserted into the slot 134. The outer leg 130*b* on the clock spring is inserted into L-shaped hook 132 on the inner surface of the spring compartment. The positioning of the slot 134 and the L-shaped hook 132 relative to each other creates the tensioning force from the clock spring 130 to bias the first shell 110 and the second shell 120 to normally open. Further, when external pressure is applied to the opposing shells 110, 120, the clock spring 130 assists in the pivoting motion along the common axis A-A of the opposing shells 110, 120 to close (see, FIG. 8), and subsequently bias open when the external pressure is removed. The external pressure is when a user, using the first indentation 114 and second indentation 124, press the opposing shells 110, 120 into a closed position. The external pressure is released when the user stops pressing into the opposing shells 110, 120 which by default would cause the opposing shells 110, 120 to return to the open position, as seen in FIG. 3.

The spring compartment 112 and the bag compartment 122 also include and interface with the locking element which operates to lock the device 100 in the closed position. In other words, the locking element locks the first and second shells 110, 120 in the closed position and prevents the tensioning force of the spring element 130 from biasing the first and second shells 110, 120 to open. FIGS. 1, 4, and 6 illustrate an example embodiment of the locking element which includes a tab 150 that is adapted to slide in a channel 152. As shown, the channel 152 is positioned along both the spring compartment 112 and the bag compartment 122. The positioning of the channel 152 is such that the tab 150 can slide within the channel 152 when the channel 152 along both the spring and bag compartment 112, 122 are lined up. FIG. 4 illustrates the channel 152 on both the spring and bag compartments 112, 122 aligned whereby the tab 150 can slide within the channel 152. As shown, the tab 150 is in an unlocked position whereby the tensioning force of the spring element 130 will bias the device 100 to the open position.

It can be readily seen in FIG. 4 that the channel 152 on the bag compartment 122 has a length longer than a length on the spring compartment 112. The length of the channel 152 on the bag compartment 122 is at least as long as a length of the tab 150 such that an entirety of the tab 150 can be positioned on the channel 152 on the bag compartment 122. In this location, the tensioning force of the spring element 130 is released allowing the device 100 to open. When the tab 150 is moved on the channel 152 toward the spring compartment 112, the tab 150 is maintained over both the spring compartment 112 and the bag compartment 122 whereby the tensioning force of the spring element 130 is resisted, preventing the tendency of the device 100 to normally open. The length of the channel 152 on the spring compartment 112 is shorter than the length of the tab 150 such that the tab 150 is positioned in the channel 152 encompassing both the spring and bag compartment 112, 122 and preventing the pivoting motion of the device 100 along the A-A axis.

As best seen in FIGS. 1 and 2, the first shell 110 and the second shell 120 may also be configured with a plurality of teeth 116, 126, respectively. The plurality of teeth 116, 126 are configured along an edge of the one or more edges 111, 121 that is opposite the edge with the spring compartment 112 and the bag compartment 122. The plurality of teeth 116, 126 may be evenly spaced along an entire length of the edge where the plurality of teeth 116, 126 are configured. The plurality of teeth 116, 126 configured along the edge that opens have several advantages. One such advantage may include that the bags pulled through the opposing shells 110, 120 can be easily separated along the plurality of teeth. Another advantage may include that the plurality of teeth 116, 126 allow pet waste deposited in tall grass to be picked up with ease.

FIGS. 1 to 3 also illustrate that the first shell 110 and the second shell 120 include the first indentation 114 and the second indentation 124, collectively referred to as indentations. The indentations 114, 124 are depressions provided on an outer surface of the first and second shells 110, 120, respectively, that are structurally depressed inward into an interior space of each of the shells 110, 120. The indentations 114, 116 may serve as finger grips allowing a secure grip on the device 100 for an improved means of using the device 100 to pick up pet waste.

Additionally, the bag compartment 122 includes a bag opening 128, which may be described as a long, narrow aperture for accessing a bag which is stored within the bag compartment 122. In the open position (see FIG. 2) a bag may be pulled through the bag opening 128 and into the enclosure formed by the first and second shells 110, 120. Preferably a roll of bags is stored within the bag compartment 122 and as a bag is pulled through the bag opening 128, a closed end of the bag remains attached to a succeeding bag. An open end of the bag is opened over the outer surfaces of the opposing shells 110, 120 while in the open position. In this position, the user may pick up the pet waste in the bag by applying pressure on the opposing shells 110, 120 to close. The bag with the pet waste is retained within the enclosure of the opposing shells. The locking element 140 may then be used to lock the opposing shells 110, 120 in the closed position to hold the pet waste within the enclosure, and then dispose of appropriately. A bag compartment cap 129 closes the open end of the bag compartment 122. The bag compartment cap 129 is removable whereby the cap can be removed to place a roll of bags in the bag compartment 122. It will be readily understood by those of ordinary skill in the art that other gap configurations are possible, such as, for example, a friction element may be used to cover the bag opening 128 allowing a bag to be pulled through yet providing some barrier to any debris entering the bag compartment 122.

Further, the device 100 may also comprise of an attachment means whereby the device may be attached to a leash or a person when taking a pet out for a walk. As shown in the figures, the attachment means may include an eyelet 160 configured on the outer surface of the spring compartment 112. It is to be understood that eyelet 160 (or other attachment means) may also be configured in any other appropriate spot which allows easy attachment, such as, but not limited to, the outer surface of the bag compartment.

Accordingly, the present description provides for various embodiments for a pet waste grab and carry device. Many uses and advantages are offered by the pet waste grab and carry device as described above in one or more non-limiting embodiments. The pet waste grab and carry device may be relatively compact, portable, and easy to use for convenient grabbing and carrying of pet waste for disposal. Many additional advantages and uses are offered by the pet waste grab and carry device described herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A device adapted to pick up pet waste, comprising:

a pair of opposing shells comprising a first shell and a second shell, configured to be placed adjacent to each other to form an enclosure;

a spring compartment having a hollow tubular body with an open end and a closed end, wherein the spring compartment is configured on the first shell and a first removable cap closes the open end of the spring compartment;

a bag compartment having a hollow tubular body with an open end and a closed end, wherein the bag compartment is configured on the second shell and a second removable cap closes the open end of the bag compartment;

wherein the closed ends of the spring and bag compartments connect to each other such that the device pivots along a common axis defined by the spring compartment and the bag compartment; and a spring element disposed within the spring compartment, wherein the spring element interfaces with the spring compartment and the bag compartment to bias the device in an open position.

2. The device of claim 1, wherein the first shell and the second shell each include an indentation adapted to provide a hand hold.

3. The device of claim 1, wherein:

the first shell has a plurality of teeth along an edge opposite an edge configured with the spring compartment;

the second shell has a plurality of teeth along an edge opposite an edge configured with the bag compartment; and wherein the plurality of teeth on the first and second shells are adapted to engage with the plurality of teeth on their respective opposing shell to substantially grasp around an item to be picked up.

4. The device of claim 1, wherein:

the closed end of the bag compartment includes a projection centrally placed and extending perpendicularly away from the hollow tubular body of the bag compartment;

the closed end of the spring compartment includes an aperture, wherein the aperture is sized to receive the projection on the bag compartment into the hollow tubular body of the spring compartment creating a connection between the first shell and the second shell; and wherein the device pivots along the axis established at the connection of the bag compartment and the spring compartment.

5. The device of claim 4, wherein the spring element is arranged over the projection of the bag compartment, wherein:

the spring element has a number of coils with an inner leg and an outer leg, wherein the inner leg engages with a slit on the projection of the bag compartment, and the outer leg engages with an L-shaped hook on an inner surface of the spring compartment such that a tensioning force of the spring element biases the pivoting of the device to open.

6. The device of claim 4, wherein the first removable cap includes a cap projection that projects into the spring compartment to snap into a gap in the projection of the closed end of the bag compartment.

7. The device of claim 1, wherein a locking element is configured along a surface of the spring and bag compartments, wherein the locking element comprises:

a channel having a length and a width configured on the spring and bag compartments, wherein a continuous channel is formed on the spring and bag compartments when the device is in a closed position;

a tab configured to fit within the channel and slide along the length of the channel;

wherein the length of the channel on the spring compartment is shorter than the length of the channel on the bag compartment such that the tab is partly positioned over the spring and bag compartments when the tab is moved toward the spring compartment, and wherein an entirety of the tab is positioned over the bag compartment when the tab is moved toward the bag compartment.

8. The device of claim 1, wherein the bag compartment includes a bag opening configured as a long, narrow aperture for accessing a bag.

9. The device of claim 1 further includes an eyelet as an attachment element, wherein the eyelet is configured on the spring compartment or on the bag compartment.

10. A device adapted to pick up pet waste, comprising:

a pair of opposing shells comprising a first shell and a second shell, wherein the first and second shells are pivotally linked to each other to form an enclosure;

a spring compartment having a hollow tubular body with an open end and a closed end, wherein the spring compartment is configured on the first shell and a first removable cap closes the open end of the spring compartment;

a bag compartment having a hollow tubular body with an open end and a closed end, wherein the bag compartment is configured on the second shell and a second removable cap closes the open end of the bag compartment;

wherein a pivoting connection is created by connecting the closed ends of the spring and bag compartments to each other, such that the first and second shells pivot along a common axis defined by the pivoting connection; and a spring element disposed within the spring compartment, wherein the spring element interfaces with the spring compartment and the bag compartment to bias the device in an open position.

11. The device of claim 10, wherein the first shell and the second shell each include an indentation adapted to provide a hand hold.

12. The device of claim 10, wherein:

the first shell has a plurality of teeth along an edge opposite an edge configured with the spring compartment;

the second shell has a plurality of teeth along an edge opposite an edge configured with the bag compartment; and wherein the plurality of teeth on the first and second shells are adapted to engage with the plurality of teeth on their respective opposing shell to substantially grasp around a product to be picked up.

13. The device of claim 10, wherein:

the closed end of the bag compartment includes a projection centrally placed and extending perpendicularly away from the hollow tubular body of the bag compartment;

the closed end of the spring compartment includes an aperture, wherein the aperture is sized to receive the projection on the bag compartment into the hollow tubular body of the spring compartment connecting the first shell and the second shell; and wherein the device pivots along the axis established at the pivoting connection of the bag compartment and the spring compartment.

14. The device of claim 13, wherein the spring element is arranged over the projection of the bag compartment, wherein:

the spring element has a number of coils with an inner leg and an outer leg, wherein the inner leg engages with a slit on the projection of the bag compartment, and the outer leg engages with an L-shaped hook on an inner surface of the spring compartment such that a tensioning force of the spring element biases the pivoting of the device to open.

15. The device of claim 13, wherein the first removable cap includes a cap projection that projects into the spring compartment to snap into a gap in the projection of the closed end of the bag compartment.

16. The device of claim 10, wherein a locking element is configured along a surface of the spring and bag compartments, wherein the locking element comprises:

a channel having a length and a width configured on the spring and bag compartments, wherein a continuous channel is formed on the spring and bag compartments when the device is in a closed position;

a tab configured to fit within the channel and slide along the length of the channel;

wherein the length of the channel on the spring compartment is shorter than the length of the channel on the bag compartment such that the tab is partly positioned over the spring and bag compartments when the tab is moved toward the spring compartment, and wherein an entirety of the tab is positioned over the bag compartment when the tab is moved toward the bag compartment.

17. The device of claim 10, wherein the bag compartment includes a bag opening configured as a long, narrow aperture for accessing a bag.

18. The device of claim 10, further includes an eyelet as an attachment element, wherein the eyelet is configured on the spring compartment or on the bag compartment.

* * * * *